United States Patent [19]

Livne

[11] Patent Number: 4,773,595

[45] Date of Patent: Sep. 27, 1988

[54] TURBINE OPERATED ROTARY SPRINKLER

[75] Inventor: Zvi Livne, Oldcastle, Canada

[73] Assignee: Dan Mamtirim, Galil Elyon, Israel

[21] Appl. No.: 902,052

[22] Filed: Aug. 26, 1986

[30] Foreign Application Priority Data

Sep. 3, 1985 [IL] Israel ..... 76281

[51] Int. Cl.[4] ..... B05B 3/16

[52] U.S. Cl. ..... 239/242; 239/203

[58] Field of Search ..... 239/203, 204, 205, 206, 239/240, 242

[56] References Cited

U.S. PATENT DOCUMENTS

| | | | |
|---|---|---|---|
| 1,864,892 | 6/1932 | Coles | 239/242 |
| 3,934,820 | 1/1976 | Phamp | 239/205 |
| 4,220,284 | 9/1986 | Beiswenger | 239/242 |
| 4,253,608 | 3/1981 | Hunter | 239/242 |
| 4,624,412 | 11/1986 | Hunter | 239/240 |

FOREIGN PATENT DOCUMENTS

| | | | |
|---|---|---|---|
| 2631752 | 1/1977 | Fed. Rep. of Germany | 239/242 |

*Primary Examiner*—Kenneth J. Dorner
*Assistant Examiner*—Gerald A. Anderson
*Attorney, Agent, or Firm*—Browdy and Neimark

[57] ABSTRACT

A turbine operated rotary sprinkler comprising a rotary nozzle, a water supply, operated turbine and rotary drive coupling means coupling the turbine to the nozzle so as to impart a rotary drive thereto, the turbine comprising a turbine wheel having a plurality of equiangularly distributed vanes each having a plane of symmetry located along a radial plane of the wheel, a pair of turbine inlets being located with respect to the wheel that water inflow sequentially through the inlets drives the wheel in respectively opposite senses, sealing means being provided for sequentially sealing the turbine inlets, displacement means being provided for displacing the sealing means into sequentially sealing the turbine inlets, displacement actuating and transmission means being provided which comprise an impact member and a rotational range defining member, the latter including a pair of spaced apart abutment elements, one of the members being rotatable with the nozzle and the other of the members being responsively coupled to the displacement means for displacing the sealing means into sequentially sealing the turbine inlets in accordance with which abutment element is contacted by the impact element, and range variation means for ranging the spacing apart of the abutment elements.

8 Claims, 2 Drawing Sheets

TURBINE OPERATED ROTARY SPRINKLER

BACKGROUND OF THE INVENTION

1. Field of the Invention

This invention relates to a turbine operated rotary sprinkler, i.e. an irrigation sprinkler having an outlet nozzle which is rotatably driven by means of a drive generated by a turbine which is itself driven by the irrigation feed supply.

2. The Prior Art

With rotary sprinklers of whatever type, the need often arises to fix and, if necessary to vary the angular segment to be irrigated. This involves ensuring that the outlet nozzle reciprocates between given angular positions, i.e. that the sense of the rotary displacement of the outlet nozzle is reversed as the nozzle reaches each of these positions.

SUMMARY OF THE PRESENT INVENTION

It is an object of the present invention to provide a turbine operated rotary sprinkler having means for varying, in a continuous fashion, the angular dimension of the segment to be irrigated.

According to the present invention there is provided a turbine operated rotary sprinkler comprising a rotary nozzle, a water supply operated turbine and rotary drive coupling means coupling said turbine to said nozzle so as to impart a rotary drive thereto wherein:

said turbine comprises a turbine wheel having a plurality of equiangularly distributed vanes each having a plane of symmetry located along a radial plane of the wheel;

a pair of turbine inlets so located with respect to the wheel that water inflow sequentially through said inlets drives said wheel in respectively opposite senses;

turbine inlet sealing means for sequentially sealing said turbine inlets;

a displacement means for displacing said sealing means into sequentially sealing said turbine inlets;

displacement actuating and transmission means comprising an impact member and a rotational range defining member, the latter including a pair of spaced apart abutment elements, one of said members being rotatable with said nozzle and the other of said members being responsively coupled to said displacement means for displacing said sealing means into sequentially sealing said turbine inlets in accordance with which abutment element is contacted by said impact element; and range variation means for varying the spacing apart of said abutment elements.

Preferably, the impact member is constituted by an impact pin which depends from a nozzle housing whilst the rotational range defining member is constituted by a guide tube mounted within a sprinkler housing so as to surround a sprinkler rotary drive axle, the tube having formed therein a pair of spiral edges, the abutment elements being respectively defined by opposite portions of the spiral edges.

With such a turbine operated, rotary dripper every time the impact member strikes an abutment element the guide tube is rotatably displaced resulting in the displacement means displacing the sealing means out of sealing one of the turbine inlets and into sealing the other inlet. Thus each impact of the impact member with an abutment element is accompanied by a reversal of the direction of rotation of the turbine wheel and in consequence, of the nozzle. The magnitude of the angular segment being sprinkled is directly dependant on the angular spacing apart of the abutment elements. In view of the fact that these abutment elements are located on the spiral edges it is clear that the angular spacing apart of the abutment edges varies along the axial dimension of the guide tube. Thus varying relative axial disposition of the impact member and the abutment elements the angle of the segment can be varied.

BRIEF DESCRIPTION OF THE DRAWINGS

For a better understanding of the present invention and to how the same can be carried out in practice, reference will now be made to the accompanying drawings in which.

DETAILED DESCRIPTION OF THE PREFERRED EMBODIMENTS

Figure 1:
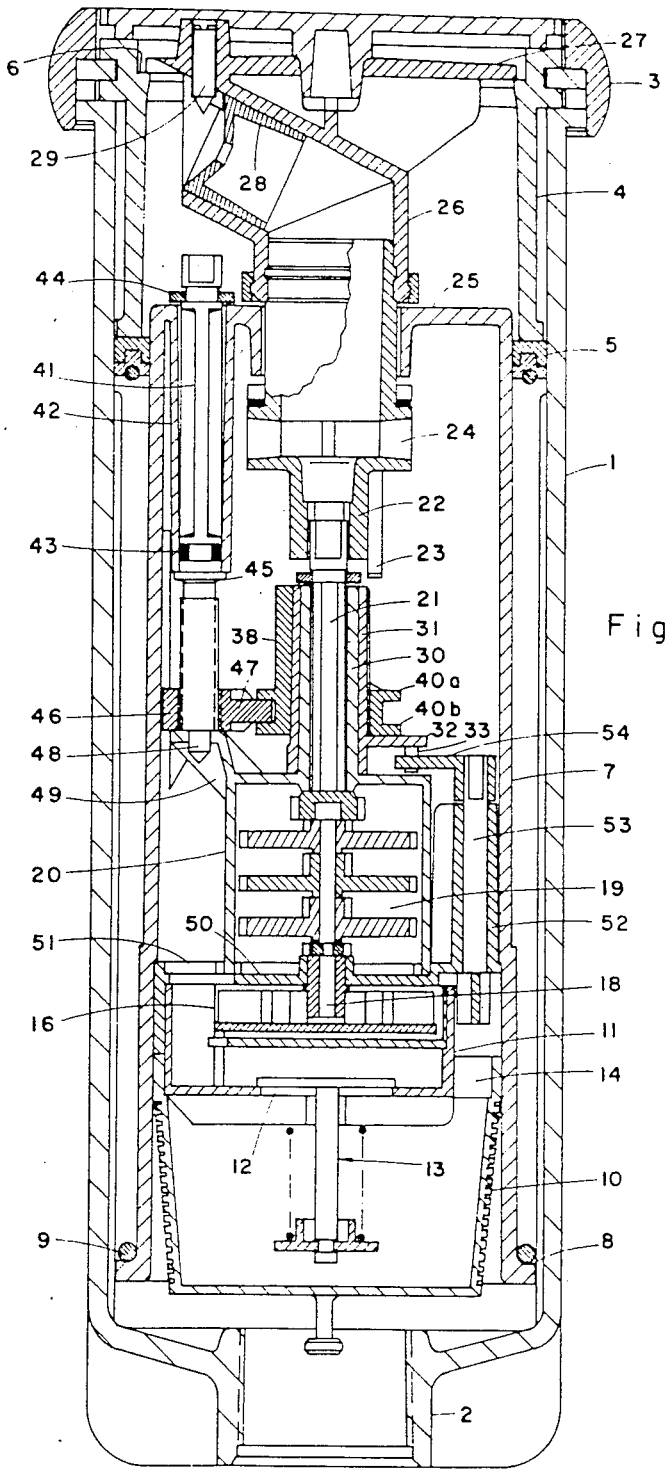
FIG. 1 is a longitudinally sectioned side elevation of a pop-up, turbine operated rotary sprinkler in accordance with the invention.

As seen in the drawings, the pop-up rotary sprinkler comprises an outer cylindrical housing (1) formed, at its base, with a water supply coupling port (2), the housing (1) being designed to be located in the ground with an upper guard rim (3) thereof substantially flush with the ground surface. Set into the upper end of the cylindrical housing (1) is a cylindrical member (4) which is coupled at its uppermost end to the guard rim (3) and is provided, at its lower end, with a sealing rim assembly (5). The cylindrical member (4) is formed with an inwardly directed flange shoulder (6).

Axially slidable within the outer housing (1) is a cylindrical, mechanism housing (7) having an outwardly directed lower flange (8). A coiled compression spring (9) bears, at its lowermost end on the lower flange (8) and at its uppermost end against the sealing assembly (5) so as to spring bias the mechanism housing (7) downwardly into the outer housing (1).

Fixed within the mechanism housing (7) is a sprinkler operating mechanism which comprises a lowermost filter cup (10) into which is securely fitted a turbine housing (11). Formed in the base of the turbine housing (11) is an aperture (12) which is normally closed by a spring loaded closure valve (13). The turbine housing (11) is formed with a main water inlet (14) which communicates with a pair of tangentially disposed turbine inlets (**15*a* and 15*b*) (see FIG. 2). Mounted in the turbine housing (11) is a turbine wheel (16) having symmetrical, radially directed turbine vanes (17). The symmetrical location of the vanes (17) and the tangential disposition of the turbine inlets (15*a* and 15*b*) ensures that when water is directed through the inlet (15*a*), the turbine wheel (16) rotates in a clockwise direction whilst when water is directed through the inlet (15*b*) the wheel (16**) rotates in an anti-clockwise direction.

The rotation of the turbine wheel (16) is transmitted via a turbine axle (18) and a gear mechanism (19), located in a gearbox (20), to a sprinkler drive axle (21). The upper end of the drive axle (21) is keyed to the lower end of a sprinkler coupling tube (22) from which depends a downwardly directed abutment pin (23). At an intermediate position in the coupling tube are formed transversely directed inlet ports (24).

The upper end of the coupling tube (22) extends through a centrally located aperture formed in an end cover (25) of the mechanism housing (7). Securely fitted to the end of the coupling tube (22) is an angular nozzle housing (26) formed integrally with a sprinkler cover plate (27). A nozzle unit (28) is fitted into the open end of the nozzle housing (26), the outer displacement of the nozzle unit (28) from the nozzle housing (26) under water pressure being prevented by a locating screw (29) which extends through the cover plate (27) so that its tip is juxtaposed with respect to the nozzle unit (28).

The drive axle (21) extends through a coaxial tubular hub (30) formed integrally with and extending upwardly from the gearbox (20). Surrounding the tubular hub (30) is a support tube (31) which is formed integrally with and located excentrically with respect to a support platform (32). The platform (32) is formed with a pair of downwardly directed pins (33*a* and 33*b*). The platform (32) is maintained in either of two desired angular positions by a pair of Ω springs (34*a* and 34*b*) respectively fitted between angular lugs (35*a* and 35*b*) formed integrally with and projecting upwardly from an upper gearbox surface (36) and corresponding recesses (37*a* and 37*b*) formed in diametrically opposite portions of the platform (32).

Figure 2:
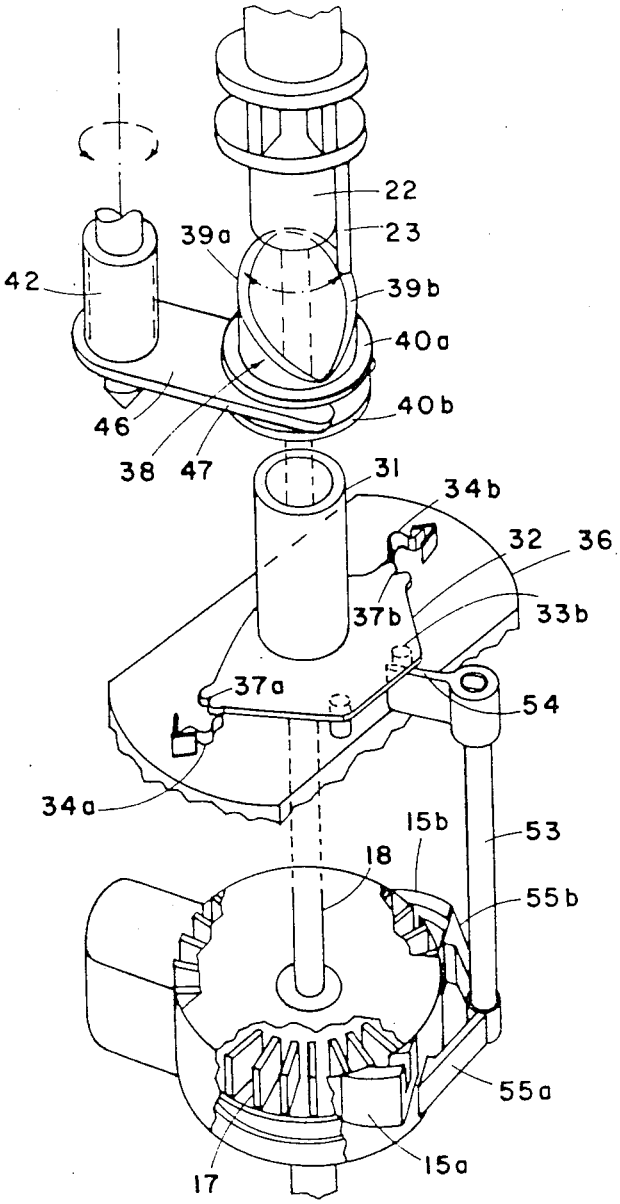
FIG. 2 is an exploded perspective view of essential components of the sprinkler shown in FIG. 1.

Surrounding the support tube (31) and keyed thereto, so as to be capable of axial movement with respect to the support tube but to be incapable of relative rotational movement, is a guide tube (38) which, as can be seen clearly in FIG. 2 of the drawings, is formed with a cutaway portion thereby exposing a pair of substantially spiral edges (39*a* and 39*b*). Formed integrally with a lower portion of the guide tube (38) is a pair of axially spaced apart, outwardly directed, peripheral flanges (40*a* and 40*b*).

An irrigation sector adjusting screw (41) extends through the end cover (25) of the mechanism housing (7) and through a downwardly depending tube (42) with respect to which it is sealed by means of a sealing ring (43). The adjustment screw (41) is held axially with respect to the tube (42) by means of an upper locking ring (44) and an intermediate flange (45) which bears against the lower edge of the tube (42) preventing upward displacement of the screw (41). The lower end of the screw (41) is threaded and is screw fitted through a correspondingly tapped aperture formed in an adjusting member (46). The latter is provided with an integral adjusting fork (47) which fits around the guide tube (38) between the peripheral flanges (40*a* and 40*b*) thereof. The lowermost end (48) of the adjusting screw is located in a bearing bracket (49) formed integrally with the gearbox (20). The adjusting screw (41) together with the adjusting fork (47) together constitute a rotational range variation means.

It can thus be seen that rotary displacement of the adjusting screw (41) results in the axial displacement of the adjusting member (46) and the corresponding axial displacement of the guide tube (38) with respect to the support tube (31).

The turbine housing (11) is formed with a cover (50) which is formed with a water through flow aperture (51) and an upwardly extending tubular boss (52) through which passes a pivoting rod (53). The upper end of the rod (53) is keyed to an arm (54) which extends under the platform (32) between the downwardly directed pins (33*a*) and (33*b*). Extending from the lowermost end of the pivoting rod (53) is a pair of angularly disposed sealing gates (55*a* and 55*b*) constituting turbine inlet sealing means. As can be seen from the drawings, the pivotal position of the arm (54) and in consequence, the pivoting rod (53), results in one or other of the gates (55*a* or 55*b*) being displaced into sealing one or other of the turbine inlets (15*a* and 15*b*). The platform 32 together with the downwardly directed pins 33*a* and 33*b* and the arm 54 and pivoting rod 53 together constitute displacement means for displacing the inlet sealing means. The abutment pin 23 (constituting an impact member) and the spiral edges 39*a* and 39*b* (constituting a rotational range defining member) together constitute displacement actuating and transmission means.

The mode of operation and use of the rotary sprinkler just described will now be set out. Upon subjecting the mechanism housing (7) and its associated components to the water supply pressure, the mechanism housing (7) and its associated components are displaced upwardly against the biasing effect of the compression spring (9). As a consequence, the nozzle housing (26) together with its nozzle unit 28 is elevated above ground level and into a position in which rotary sprinkling can be effected. A water supply flow will now pass into the turbine housing (11) via the main water inlet (14) through one or other of the turbine inlets (15*a* or 15*b*) causing the turbine wheel to rotate. The rotation of the turbine wheel (16) is transmitted via the turbine axle (18) and the gear mechanism (19) to the drive axle (21) and from there, via the coupling tube (22) to the nozzle housing (26). In this way the through flowing water supply is effective in rotating the nozzle housing (26).

The supply flow emerging from the turbine wheel (16) and from the aperture (12) passes out of the turbine housing (11) through the water through flow aperture (51) and into the coupling tube (22) via the transverse inlet ports (24) thereof so as to emerge from the nozzle unit (28). In this way a rotary sprinkling effect is obtained.

In the arrangement shown in FIG. 1 of the drawings, the actuation of the turbine wheel by the water supply is effective in securing a continous rotation of the nozzle housing seeing that there is nothing which offers any obstacle to the continuing rotation of the nozzle housing and its associated parts.

When, however, it is desired to restrict the segment being sprinkled to an angular segment of less than 360°, this is effected by means of the adjusting screw (41). Thus, by clockwise rotation of the adjusting screw the adjusting member (46) is raised and this results in the upward axial displacement of the guide tube (38). Once this upward displacement has reached a position wherein the tip of the abutment pin (23) is located between opposite spiral edges (39*a* and 39*b*) of the guide tube, the following takes place;

Referring to FIG. 2 of the drawings, it can be seen that, as soon as the abutment pin (23) strikes the spiral edge (39*b*) the support tube (31) and, in consequence the support platform (32), is displaced in an anti-clockwise direction out of the position shown in FIG. 2 of the drawings in which it has been held by the Ω springs (34*a* and 34*b*) into a second position wherein the downwardly directed pin (33*a*) strikes the arm (54). In consequence the arm (56) together with the pivoting rod (53) pivots in a clockwise direction thereby causing the sealing gate (55*a*) to close the turbine inlet (15*a*) and allow for the opening of the turbine inlet (15*b*). Once this has happened, the supply flow enters the turbine wheel through the inlet (15*b*) causing the turbine wheel to rotate in an anti-clockwise direction and this rotational movement is imparted to the nozzle housing (26).

With the continued rotation of the nozzle housing, the abutment pin (23) strikes the spiral edge (39*b*) and the process described above is reversed and as a consequence the inlet (15*a*) is once again opened whilst the inlet (15*b*) is closed and the turbine wheel and the housing rotate in a clockwise direction. It will be readily seen that the higher the guide tube (38) is raised vis a vis the abutment pin (23) the smaller will be the angular segment being sprinkled. The angular segment being sprinkled can be continuously varied by simple rotation of the adjusting screw (41) and consequent raising and lowering of the guide tube (38). Thus the segment can be varied from a continuous rotation of 360° down to a minimal angular segment, all depending on the nature and spatial location of the spiral edges (39*a* and 39*b*).

A rotary sprinkler is designed to operate with a certain minimum headloss therethrough so as to ensure that the water emerging from the nozzle unit has a sufficient range. Now with a turbine operated sprinkler there is inevitably an in-built headloss due to the operation of the turbine and therefore this in-built loss must be taken into consideration when designing the sprinkler so as to ensure that the outflowing water nevertheless has an adequate range. Now as long as the outlet aperture in the nozzle unit is sufficiently small, it can generally be ensured that the overall headloss in the sprinkler remains sufficiently great despite the in-built headloss due to the turbine, for the outflowing water to have the required range. Where, however, as a result of the choice of a nozzle unit with a relatively large aperture the overall headloss in the sprinkler drops, the fact that the sprinkler is turbine operated means that the in-built headloss due to the turbine becomes sufficiently great for the overall headloss in the sprinkler not to be adequate to maintain the required range.

Thus, for example, a sprinkler can be designed to operate at a supply pressure equivalent to 2 atm. where the headloss arising out of the operation of the turbine is of the order of 0.3 atm. As a consequence, the remaining headloss of 1.7 atm. is sufficient to ensure an adequate range and distribution of the out-flowing water. Where, however, a nozzle unit having a relatively large outlet aperture is employed, the consequent relative free through flow of water through the sprinkler is such that the overall headloss in the sprinkler drops considerably and, under these circumstances, the 0.3 atm. headloss due to the operation of the turbine carries with it as a consequence the fact that the range and distribution of the outflowing water will be seriously reduced.

In order to overcome this serious disadvantage, the sprinkler has been provided with a bypass aperture (12) and a spring-loaded closure valve (13). As long as an adequate headloss is generated in the sprinkler to ensure adequate distribution and range, then the pressure difference on either side of the closure valve (13) is such that the spring-loaded valve remains closed. When, however, as a result of the reduction of this pressure difference because of the lowering of the headloss due to the use of a large apertured nozzle unit), the closure valve opens and the inflowing supply in addition to flowing through the turbine wheel so as to cause rotation of the turbine and the nozzle housing also bypasses the turbine wheel and flows directly to the nozzle housing and in this way an adequate headloss is maintained so as to ensure adequate distribution and range of the outflowing water.

Whilst the invention has been specifically described with reference to a pop-up sprinkler it will be realised that it is equally applicable to rotary sprinklers whose nozzles are permanently maintained in their above ground sprinkling level.

I claim:

1. A turbine operated rotary sprinkler comprising a housing, a rotary nozzle, a water supply operated turbine and rotary drive coupling means coupling said turbine to said nozzle so as to impart a rotary drive thereto wherein:

said turbine comprises a turbine wheel having a plurality of equiangularly distributed vanes each having a plane of symmetry located along a radial plane of the wheel;

a pair of turbine inlets so located with respect to the wheel that water inflow sequentially through said inlets drives said wheel in respectively opposite directions;

turbine inlet sealing means for sequentially sealing said turbine inlets;

a displacement means for displacing said sealing means into sequentially sealing said turbine inlets;

an impact member;

a rotational range defining member formed with a pair of linear edges located on either side of a rotational axis of said sprinkler and diverging outwardly along said axis in a direction towards said nozzle opposite portions of said linear edges constituting abutment elements and;

an adjusting screw held against axial displacement with respect to the sprinkler housing and screw coupled to one of said members whereby screw rotation of said adjusting screw results in the axial displacement of said one member, so as to vary the spacing between the constituent abutment elements and into and out of a position wherein said impact member does not contact said abutment elements, one of said members being rotatable with said nozzle and the other of said members being responsively coupled to said displacement means for displacing said sealing means into sequentially sealing said turbine inlets in accordance with which abutment element is contacted by said impact element.

2. A rotary sprinkler according to claim 1 wherein said impact member is rotatable with said nozzle and said rotational range defining member is responsively coupled to said displacement means.

3. A rotary sprinkler according to claim 2 wherein said impact member is constituted by an impact pin which depends from a housing of said nozzle whilst said rotational range defining member is constituted by a guide tube mounted within a sprinkler housing so as to surround a sprinkler drive axle, said tube having formed therein a pair of substantially spiral edges constituting said linear edges.

4. A rotary sprinkler according to claim 3 wherein said guide tube is formed with a peripheral flange and wherein said range variation means includes a lifting fork adapted to embrace said guide tube below said peripheral flange and to be screw-coupled to said adjusting screw.

5. A rotary sprinkler according to any claim 3 wherein said guide tube is rigidly coupled to a support element having a pair of striker elements, spring support means being provided for supporting said support element in one or other of two rotary positions, said support means being displaced from one rotary position to the other as a consequence of the impacting of the abutment elements by said impact member.

6. A rotary sprinkler according to claim 5 wherein said sealing means comprises a pair of sealing gates, a pivoting rod being rigidly coupled at one end thereof to said sealing gates and at an opposite end thereof to an arm which extends between said striker elements, the arrangement being such that the striking of said arm by either of said striker elements results in the displacement of one or other of said sealing gates into or out of a sealing position.

7. A rotary sprinkler according to claim 1 wherein there is provided a by-pass inlet for said sprinkler, a spring loaded valve controlling throughflow through said by-pass inlet, the arrangement being such that when the pressure differential across said by-pass inlet exceeds a predetermined maximum, said inlet opens and water flows therethrough to said nozzle bypassing said turbine.

8. A rotary sprinkler according to claim 1 wherein said sprinkler is of the pop-up type.

* * * * *